US005809921A

United States Patent [19]

Mok

[11] Patent Number: 5,809,921

[45] Date of Patent: Sep. 22, 1998

[54] METHOD FOR GENERATING A CONTINUOUSLY STITCHED REGIONAL CARVED FILL COMPOSITE EMBROIDERY STITCH PATTERN

[75] Inventor: Man-Kam Mok, Markham, Canada

[73] Assignee: Pulse Microsystems Ltd., Ontario, Canada

[21] Appl. No.: 794,010

[22] Filed: Feb. 3, 1997

[51] Int. Cl.[6] ..... D05C 5/02

[52] U.S. Cl. ..... 112/475.19; 112/102.5

[58] Field of Search ..... 122/475.19, 475.18, 122/102.5, 456, 457, 458, 454, 470.06; 364/470.09

[56] References Cited

U.S. PATENT DOCUMENTS

| | | | |
|---|---|---|---|
| 5,335,182 | 8/1994 | Asano | 112/475.19 X |
| 5,386,789 | 2/1995 | Futamura et al. | 112/475.19 X |
| 5,499,589 | 3/1996 | Kyuno et al. | 112/475.19 X |
| 5,558,031 | 9/1996 | Muto et al. | 112/102.5 |
| 5,592,891 | 1/1997 | Muto | 112/475.19 |

*Primary Examiner*—Peter Nerbun
*Attorney, Agent, or Firm*—Bryan Cave LLP

[57] ABSTRACT

A method for generating a continuously stitched regional carved fill composite embroidery stitch pattern, in which the composite stitch pattern comprises one or more carved fill stitch patterns disposed in a defined fill region in a background region which comprises a background embroidery stitch pattern, includes the steps of detecting regions of overlap in the composite embroidery stitch pattern between the background stitch pattern and the carved fill stitch pattern, and selectively stitching the composite embroidery stitch pattern by filling the areas of overlap solely with the carved fill stitch pattern wherever the overlap is detected and filling the areas of no such overlap in the composite embroidery stitch pattern solely with the background stitch pattern wherever the overlap is not detected during the continuous stitching of the composite embroidery stitch pattern. The carved fill pattern is, thereby, not stitched on top of the background pattern in the resulting composite embroidery stitch pattern even though the visual effect is one of layering. In accordance with the present method, there may be multiple carved filled regions which are layered on top of each other or which are spaced apart in a non-contiguous manner over the background region, and each of these carved filled patterns may be different from each other. Moreover, the carved fill pattern may be complex or simple, such as a tile pattern, or one in which the area of no overlap comprises a hole in the carved fill stitch pattern. Because this method is a continuous stitching operation, the composite pattern or design may be completed in a single stitching operation.

15 Claims, 8 Drawing Sheets

METHOD FOR GENERATING A CONTINUOUSLY STITCHED REGIONAL CARVED FILL COMPOSITE EMBROIDERY STITCH PATTERN

BACKGROUND OF THE INVENTION

1. Field of the Invention

The present invention relates to methods for generating carved fill embroidery stitch patterns, and more particularly to a method for generating a continuously stitched regional carved fill composite embroidery stitch pattern.

2. Description of the Related Art

The use of carved fill patterns in embroidery is well known in the art. In this regard, there have been prior art methods which attempt to generate regional carved fill patterns by stitching a second pattern on top of a first previously stitched pattern. However, such a prior art approach is unsatisfactory in that it results in undesirable embroidery by having to actually stitch on top of other stitches. In order to try to overcome this problem, there have been prior art attempts to leave a blank area in the underlying background during a first stitching operation and then go back to and restitch the blank area during a separate stitching operation. This is also unsatisfactory in that it is inefficient and time consuming and can become unmanageable where there are multiple non-contiguous blank areas to be filled in with different patterns or where there are multiple layers composed of a plurality of different patterns. In addition, prior art attempts at doing regional carved fill do not allow part of a carved fill to visually show through a hole in another region. Thus, in applicant's opinion, the use of regional carved fill in composite embroidery stitch patterns has not been able to reach its fullest potential. These disadvantages of the prior art are overcome by the present invention.

SUMMARY OF THE INVENTION

A method for generating a continuously stitched regional carved fill composite embroidery stitch pattern, in which the composite stitch pattern comprises one or more carved fill stitch patterns disposed in a defined fill region in a background region which comprises a background embroidery stitch pattern, includes the steps of detecting regions of overlap in the composite embroidery stitch pattern between the background stitch pattern and the carved fill stitch pattern, and selectively stitching the composite embroidery stitch pattern by filling the areas of overlap solely with the carved fill stitch pattern wherever the overlap is detected and filling the areas of no such overlap in the composite embroidery stitch pattern solely with the background stitch pattern wherever the overlap is not detected during the continuous stitching of the composite embroidery stitch pattern. The carved fill pattern is, thereby, not stitched on top of the background pattern in the resulting composite embroidery stitch pattern even though the visual effect is one of layering. In accordance with the present method, there may be multiple carved filled regions which are layered on top of each other or which are spaced apart in a non-contiguous manner over the background region, and each of these carved filled patterns may be different from each other. Moreover, the carved fill pattern may be complex or simple, such as a tile pattern, or one in which the area of no overlap comprises a hole in the carved fill stitch pattern. Because this method is a continuous stitching operation, the composite pattern or design may be completed in a single stitching operation.

DETAILED DESCRIPTION OF THE INVENTION

Figure 1:
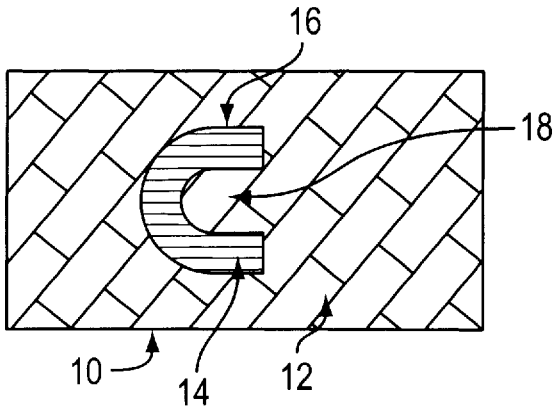
FIG. 1 is a diagrammatic illustration of a carvable segment generated in accordance with the presently preferred method of the present invention.
Figure 2:
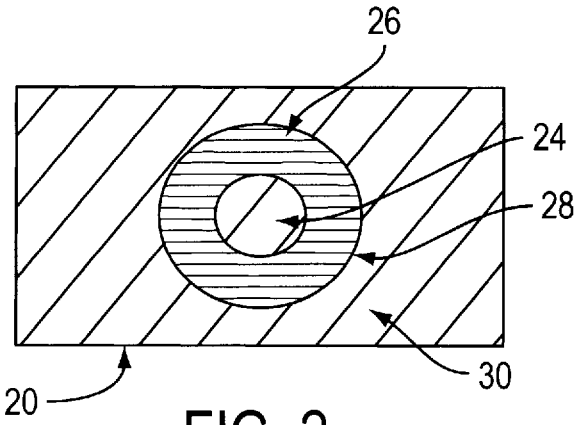
FIG. 2 is a diagrammatic illustration of a different carvable segment generated in accordance with the presently preferred method of the present invention.
Figure 3:
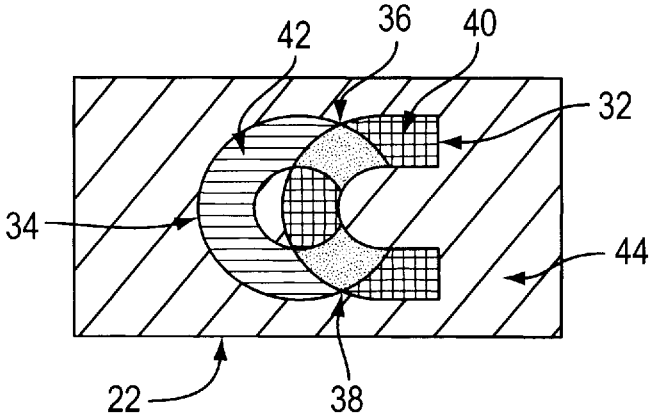
FIG. 3 is a diagrammatic illustration of still a different carvable segment generated in accordance with the presently preferred method of the present invention.

Referring now to the drawings in detail, and initially to FIG. 1, FIG. 1 illustrates an example of a carvable segment 10 which may be generated in accordance with the presently preferred method of the present invention. As illustrated in FIG. 1, the carvable segment 10 includes a background embroidery stitch pattern 12 which occupies the background region of the composite segment 10, and a carved fill pattern 14 which fills the shape, illustrated as the letter C, which is the defined fill region 16 in the composite embroidery stitch pattern 10. As shown and preferred in the example of FIG. 1, the open area 18 in the defined fill region 16 is occupied by the background stitch pattern 12. FIGS. 2 and 3 illustrate other examples of different types of carvable segments 20, 22, respectively, which may be generated, by way of example, in accordance with the presently preferred method of the present invention. FIG. 2 illustrates a carvable segment 20 with a hole 24 in the carved fill stitch pattern 26 in the defined fill region 28 located on the background embroidery stitch pattern 30. FIG. 3 illustrates a layering of regional carved segments, with two such layered segments 32, 34 being shown by way of example. The layered segments 32, 34 have overlapping areas 36, 38. Two different patterns 40, 42 are shown, by way of example, in the respective carved fill regions 32, 34 located on the background embroidery stitch pattern 44.

Figure 5:
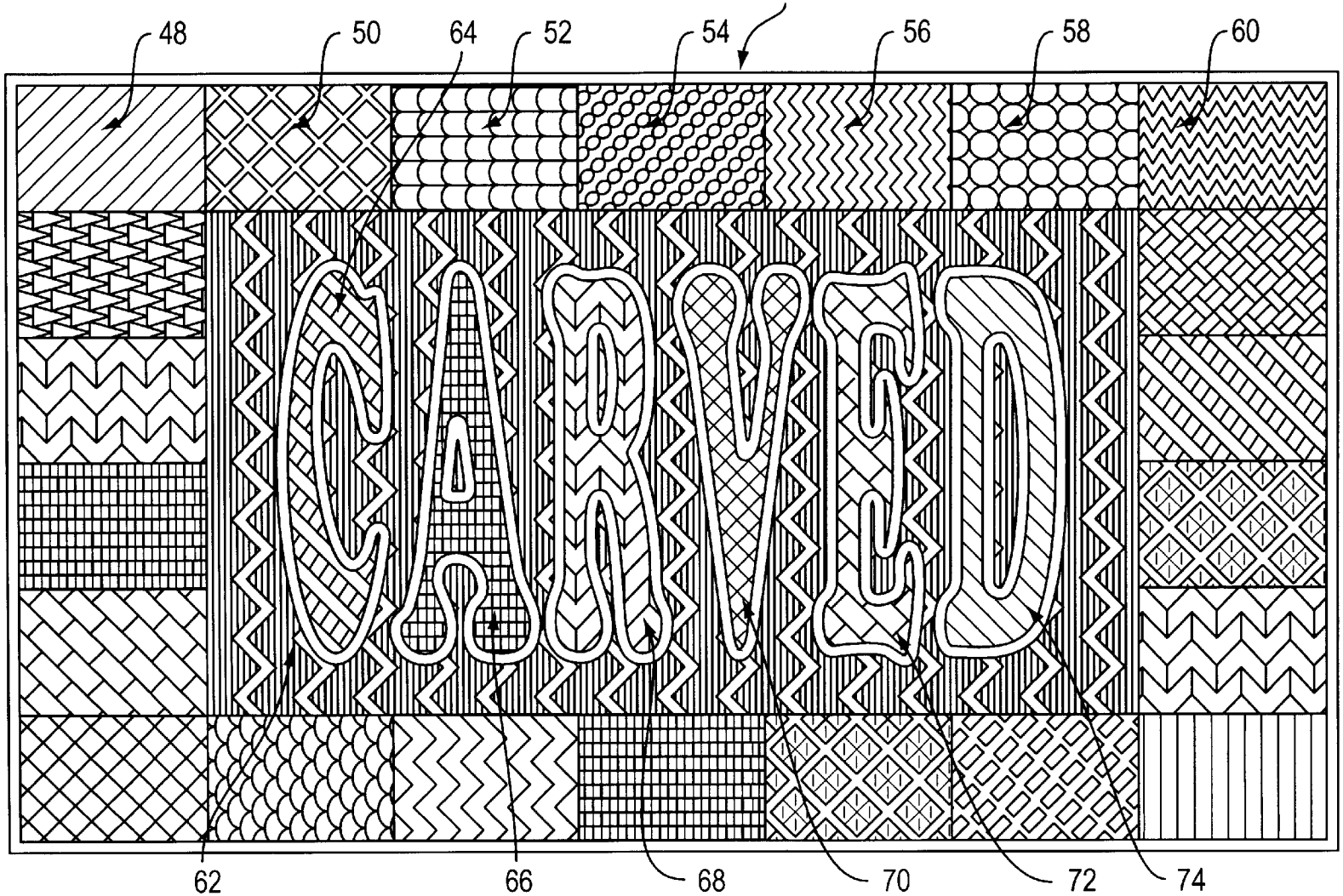
FIG. 5 is a diagrammatic illustration of a continuously stitched regional carved fill composite embroidery stitch pattern generated in accordance with the presently preferred method of the present invention.
Figure 6A:
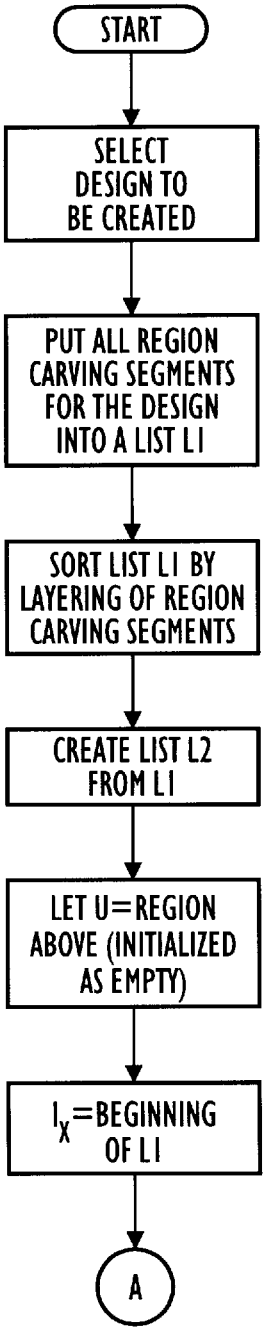
FIGS. 6A–6E comprise a diagrammatic illustration of a flow diagram of the presently preferred method of the present invention.
Figure 6B:
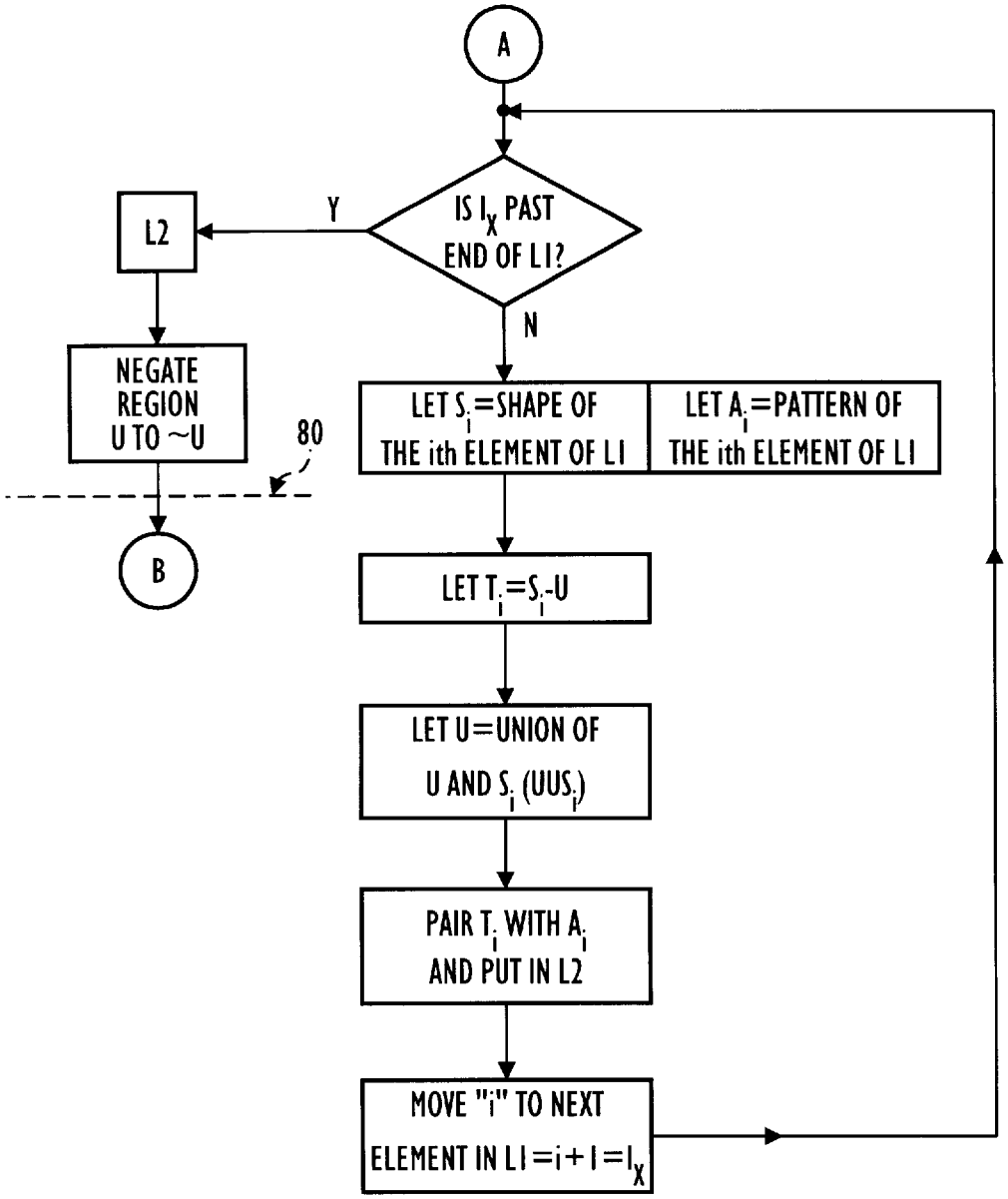
Figure 6C:
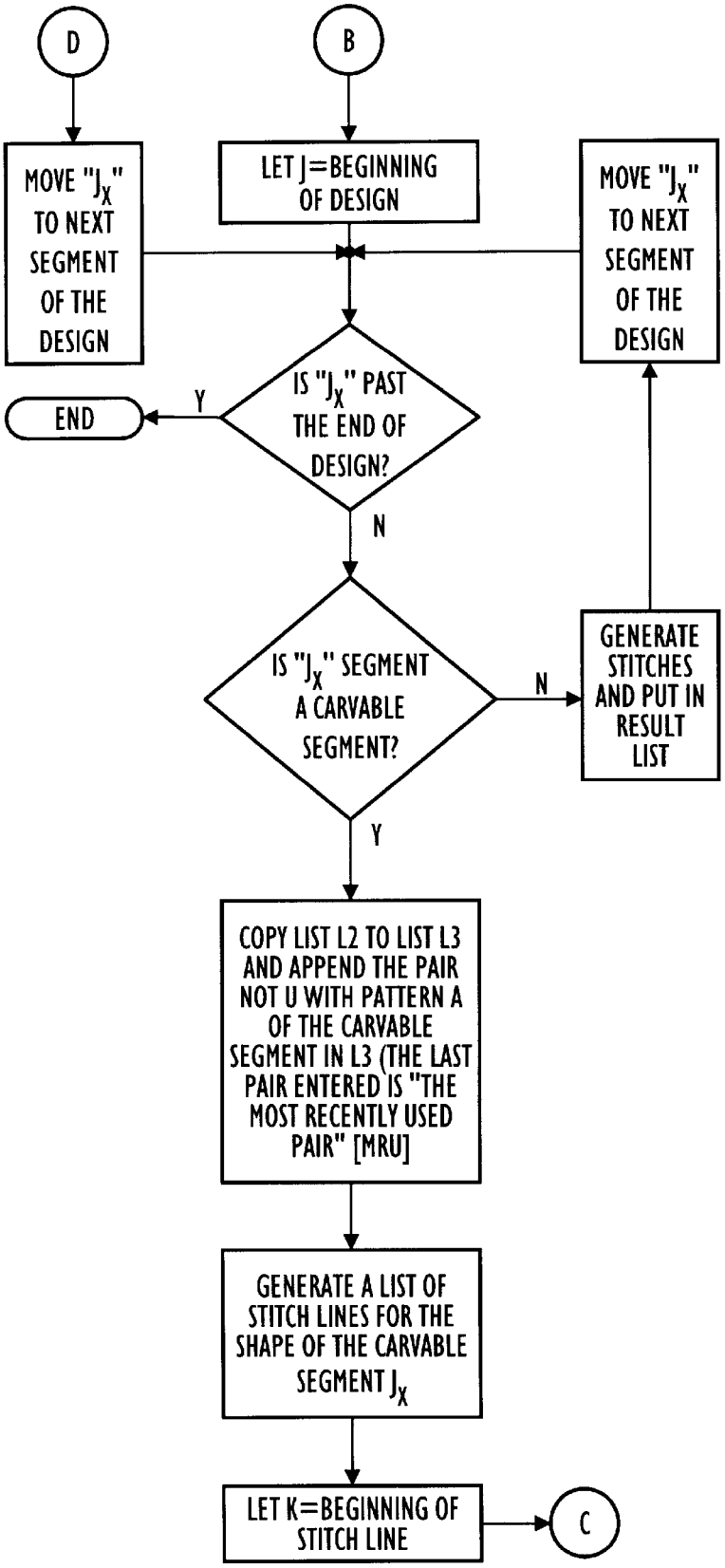
Figure 6D:
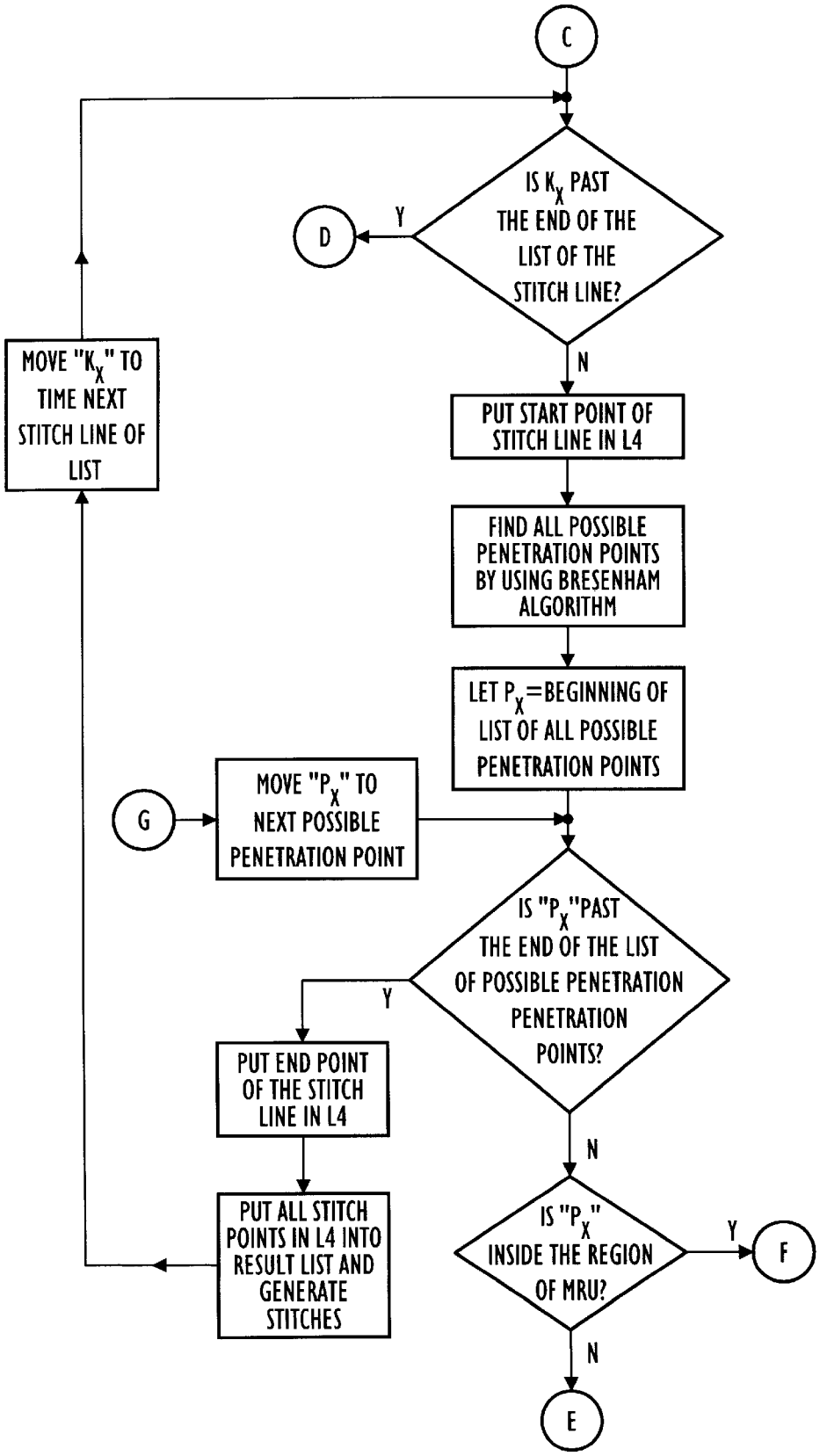
Figure 6E:
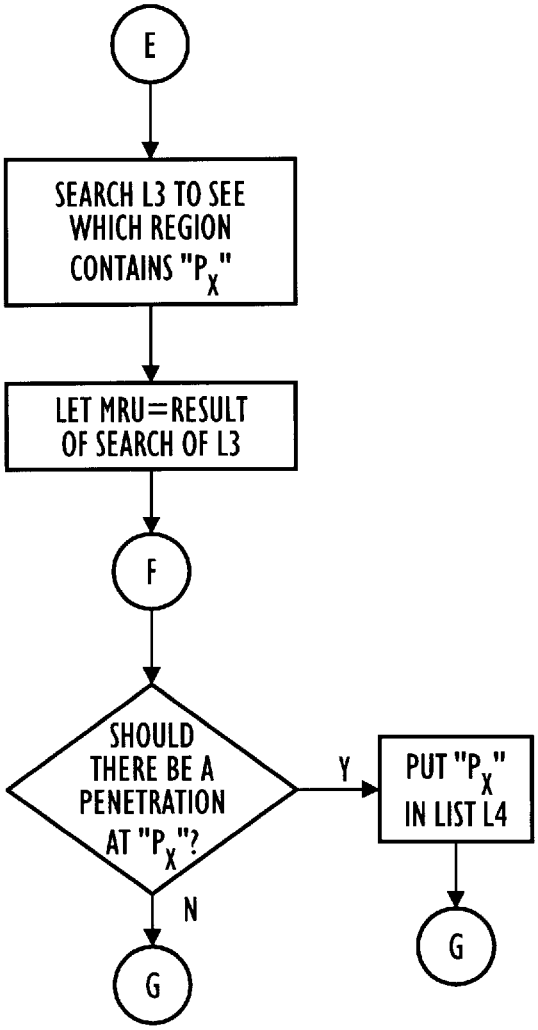

FIG. 5 illustrates a complex complete embroidery stitch pattern 46 capable of being generated in accordance with the presently preferred method of the present invention. As shown by way of example in FIG. 5, the complete pattern 46 includes a plurality of different tile pattern background stitch patterns 48, 50, 52, 54, 56, 58, 60, etc. around the border, and another tile pattern background stitch pattern 62 which contains a plurality of non-contiguous defined fill regions 62, 64, 66, 68, 70, 72, 74, which are illustrated as spelling out the word "CARVED", which are filled with different carved fill stitch patterns, respectively, in accordance with the presently preferred method of the present invention. Of course, if desired, although different carved fill stitch patterns are illustrated, or different stitch patterns for the carved fill and the background, the operator may make any choices he or she wishes in accordance with the presently preferred method of the present invention.

Figure 4A:
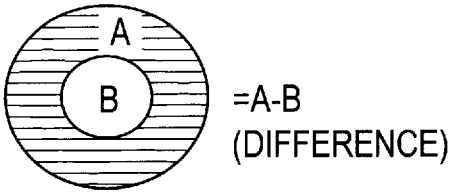
FIGS. 4A–4D are graphical illustrations of regions useful in explaining the presently preferred method of the present invention.
Figure 4B:
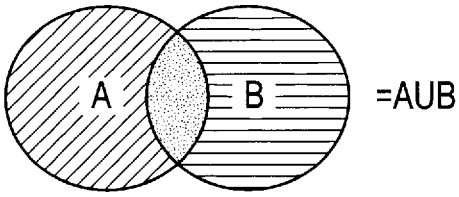
Figure 4C:
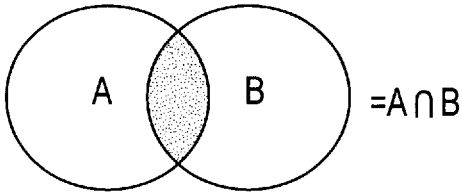
Figure 4D:
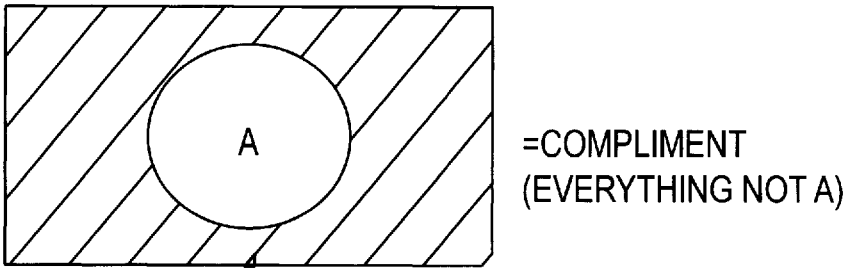

Before describing the presently preferred method of the present invention in greater detail, it is believed that a brief explanation of the concepts involved may be helpful with reference to FIGS. 4A–4D. An embroidery design generally comprises a list of segments which contain the information to be stitched out, with each segment containing a shape and stitch generation information. The shape is a mathematical representation of a graphical object and tells you the boundary contour and/or region of the shape. The region is a mathematical representation of a shape/graphical object and indicates whether a given stitch point is inside, outside, or on the boundary of the shape. FIG. 4A illustrates a difference of regions which is the set difference of two shapes; in other words, the area not covered by pattern B in the illustrated example. FIG. 4B illustrates the union of two regions which is the set union of two shapes; in other words, the area covered by both patterns A and B in the illustrated example. FIG. 4C illustrates the intersection of two regions which is the set intersection of two shapes; in other words, the area of overlap of patterns A and B in the illustrated example. FIG. 4D illustrates the complement of two regions which is the set complement of the shape; in other words, everything but pattern A in the illustrated example.

The presently preferred method of the present invention may be carried out using a microprocessor controlled embroidery machine using a control program created, by way of example, using an IBM THINK PAD 560, having 32 MB of RAM, and a speed of 133MHz capable of running WINDOWS 95 or WINDOWS NT, and written in C++. FIGS. 6A–6E comprise an illustrative flow diagram of such a program for carrying out the presently preferred method of the present invention, with "L1" corresponding to a list of shape versus pattern, and with "L2" corresponding to a list of shape versus pattern which associates a particular pattern with a particular shape. The flow diagram of FIGS. 6A–6E is self explanatory to a person of ordinary skill in the art and need not be described in greater detail to enable that person to readily carry out the programmed operation. Suffice it to say that no stitches are generated up to the point 80 illustrated by the dotted line in FIG. 6B. In carrying out the method, all the region carving segments from the design are put into list L1 sorted by layering, with the region U and list L2 being empty at this time. For each region carving segment in list L1, these segments are formed top most to bottom, finding the region of the segment that is not overlaid with region U and the result is appended with the carved pattern to list L2. The region covered by both the segment and region U is also found and the result put to region U. At this point, effectively two things are preferably done: the list L2 of non-covering region and its corresponding carved fill pattern pair is found, and the region covered by at least one of the region carvings is found. Next, preferably, the region U is negated, with the negated region U being the region that is not covered by any region carving segment. Up to this point 80, preferably, no stitches have been generated. When we begin to generate stitches for each carvable segment with its pattern A, list L2 is copied to list L3 and the pair negated U is appended with A to list L3, with negated U and A being the most recently used pair or MRU. For each stitch line of the carvable segment, we need to find a list of stitch points and in order to do this, we preferably find all possible penetration points by the well known Bresenham algorithm. For each possible penetration point P, a determination as to whether or not P is outside the region of MRU and then the list L3 is searched to see which region contains P and it is then remembered as MRU. The pattern of the MRU is then asked whether a stitch should be dropped at P and, if YES, then P is put into list L4. Preferably, you then ensure that list L4 contains the end points of the stitch line and all stitch points in list L4 are put to the result list.

Briefly summarizing the above discussion, the presently preferred method of the present invention enables a continuously stitched regional carved fill composite embroidery stitch pattern to be generated, such as the composite patterns illustrated, by way of example, in FIGS. 5, and 1–3. In this regard, the composite pattern comprises one or more carved fill patterns disposed in one or more defined fill regions in a background region which comprises a background embroidery stitch pattern. As noted above, preferably the carved fill pattern comprises a different stitched pattern from the background embroidery stitch pattern, but it need not be. The defined fill region contains the region carving segment which has a defined shape which is filled with the carved fill stitch pattern. The defined fill region, as explained above, comprises an area of overlap between the background embroidery stitch pattern and the carved fill stitch pattern, with the background embroidery stitch pattern also comprising areas of no overlap between the background embroidery stitch pattern and the carved fill pattern. In carrying out the presently preferred method of the present invention, the regions of overlap are detected and the composite embroidery stitch pattern is selectively stitched by filling the areas of overlap solely with the carved fill stitch pattern wherever the overlap is detected and filling the areas of no overlap solely with the background stitch pattern wherever the overlap is not detected during the continuous stitching of the composite embroidery stitch pattern. As noted above, where the carved fill regions overlay each other, the uppermost carved fill region is filled in at any overlap portion with the carved fill pattern associated with that uppermost carved fill layer.

By using the method of the present invention, the carved fill pattern is not stitched on top of the background stitch pattern even though the visual effect presented creates this visual image, and the entire composite regional carved fill embroidery stitch pattern may be stitched in one continuous operation.

What is claimed is:

1. A method for generating a continuously stitched regional carved fill composite embroidery stitch pattern, said composite stitch pattern comprising a carved fill pattern disposed in a defined fill region in an underlying base background region, said base background region comprising an underlying base background embroidery stitch pattern in said composite embroidery stitch pattern, said carved fill pattern comprising a different stitched pattern from said underlying base background embroidery stitch pattern, said defined fill region comprising a region carving segment having a defined shape fillable by using said carved fill stitch pattern, said defined fill region comprising a first area of overlap between said underlying base background embroidery stitch pattern and said carved fill stitch pattern, said underlying base background embroidery stitch pattern further comprising a second area of no overlap between said underlying base background embroidery stitch pattern and said carved fill stitch pattern, said method comprising the steps of detecting said regions of overlap in said composite embroidery stitch pattern, and continuously selectively stitching said composite embroidery stitch pattern across said composite pattern by continuously filling said composite pattern in a fill line by fill line continuous fill sequence across said composite pattern by filling both said first area of overlap in said fill line solely with said carved fill stitch pattern wherever said overlap is detected in said fill line and filling said second area of no overlap in said fill line solely with said background stitch pattern wherever said overlap is not detected in said fill line during said continuous fill sequence during said continuous stitching of said composite embroidery stitch pattern; whereby said carved fill pattern is not stitched on top of said background pattern.

2. A method in accordance with claim 1 wherein said composite embroidery stitch pattern comprises a plurality of separate carved fill regions disposed on said background region, said selective stitching step comprising the step of filling each of said carved fill regions with a carved fill pattern different from said underlying base background embroidery pattern during said continuous fill sequence.

3. A method in accordance with claim 2 wherein said step of filling said at least two of said carved fill regions further comprises the step of filling at least two carved fill regions with patterns different from each other and from said underlying base background embroidery stitch pattern.

4. A method in accordance with claim 2 wherein said carved fill regions do not overlap each other.

5. A method in accordance with claim 3 wherein said at least two carved filled regions have an overlapped portion and a non-overlapped portion for providing a layering of one of said two carved fill regions on the other, said step of filling said at least two carved filled regions further comprises the step of filling the uppermost carved fill region of said two carved fill regions in said overlapped portion solely with said carved fill pattern associated with said uppermost carved fill region.

6. A method in accordance with claim 2 wherein said plurality of separate carved fill regions comprises at least two carved fill regions which overlap each other.

7. A method in accordance with claim 6 wherein said plurality of carved fill regions comprises at least two carved fill regions have an overlapped portion and a non-overlapped portion for providing a layering of one of said two carved fill regions on the other, said step of filling said at least two carved filled regions further comprises the step of filling the uppermost carved fill region of said two carved fill regions in said overlapped portion solely with said carved fill pattern associated with said uppermost carved fill region.

8. A method in accordance with claim 2 wherein said carved fill pattern in each of said carved fill regions comprises a carved fill pattern associated with said carved fill region, said method further comprising the step of filling each of said carved fill regions with said associated carved fill pattern during said continuous fill sequence wherever said carved fill region overlaps said underlying base background embroidery stitch pattern.

9. A method in accordance with claim 8 wherein at least two of said associated carved fill patterns are different from each other, said method further comprising the step of filling said at least two carved fill regions with said different associated carved fill patterns during said continuous fill sequence wherever said at least two carved fill regions overlap said underlying base background embroidery stitch pattern.

10. A method in accordance with claim 2 wherein said plurality of separate carved fill regions comprises at least two carved fill regions which are non-contiguous to each other in said composite embroidery stitch pattern.

11. A method in accordance with claim 1 wherein said carved fill stitch pattern comprises a tile pattern.

12. A method in accordance with claim 1 wherein said second area of no overlap comprises a hole in said carved fill stitch pattern in said defined fill region.

13. A method in accordance with claim 1 wherein said carved fill pattern in each of said carved fill regions comprises a carved fill pattern associated with said carved fill region, said method further comprising the step of filling each of said carved fill regions with said associated carved fill pattern during said continuous fill sequence wherever said carved fill region overlaps said underlying base background embroidery stitch pattern.

14. A method in accordance with claim 13 wherein at least two of said associated carved fill patterns are different from each other, said method further comprising the step of filling said at least two carved fill regions with said different associated carved fill patterns during said continuous fill sequence wherever said at least two carved fill regions overlap said underlying base background embroidery stitch pattern.

15. A method for generating a continuously stitched regional carved fill composite embroidery stitch pattern, said composite stitch pattern comprising a carved fill pattern disposed in a defined fill region in an underlying base background region, said base background region comprising an underlying base background embroidery stitch pattern in said composite embroidery stitch pattern, said carved fill pattern comprising a different stitched pattern from said underlying base background embroidery stitch pattern, said defined fill region comprising a region carving segment having a defined shape fillable by using said carved fill stitch pattern, said defined fill region comprising a first area of overlap between said underlying base background embroidery stitch pattern and said carved fill stitch pattern, said underlying base background embroidery stitch pattern further comprising a second area of no overlap between said underlying base background embroidery stitch pattern and said carved fill stitch pattern, said composite stitch pattern further comprising at least two carved fill regions disposed on said underlying base background region, said method comprising the steps of detecting regions of overlap in said composite embroidery stitch pattern, and continuously selectively stitching said composite embroidery stitch pattern in a continuous fill sequence by filling said first area of overlap solely with said carved fill stitch pattern wherever said overlap is detected and filling said second area of no overlap solely with said underlying base background stitch pattern wherever said overlap is not detected in said composite embroidery stitch pattern during said continuous stitching of said composite embroidery stitch pattern, said at least two carved fill regions having an overlapped portion and a non-overlapped portion, said continuous selective stitching step further comprising the step of layering one of said at least two carved filled regions on the other on said underlying base background region, the uppermost carved fill region of said at least two layered carved fill regions being filled in said overlapped portion solely with said carved fill pattern associated with said uppermost carved fill region; whereby a layered carved fill pattern is not stitched on top of said background embroidery stitch pattern.

* * * * *